US005864880A

United States Patent [19]

Adam

[11] Patent Number: 5,864,880

[45] Date of Patent: Feb. 2, 1999

[54] JERSEY FOR USE WITH LIQUID DELIVERY SYSTEM

[76] Inventor: Gerald David Adam, 201-141 East 6th Street, North Vancouver, Canada

[21] Appl. No.: 86,344

[22] Filed: May 29, 1998

Related U.S. Application Data

[60] Provisional application No. 60/051,423, Jul. 1, 1997.

[51] Int. Cl.[6] ..... A45F 3/20; A41D 1/04

[52] U.S. Cl. ..... 2/94; 2/108; 2/115; 224/148.2; 224/148.3

[58] Field of Search ..... 2/94, 102, 108, 2/115, 106, 69, 69.5, 117, 247, DIG. 3; 224/148.1, 148.2, 148.3, 148.4, 148.5, 148.6, 600, 627, 637, 638; 222/175

[56] References Cited

U.S. PATENT DOCUMENTS

| | | | |
|---|---|---|---|
| 2,248,455 | 7/1941 | Freund | 2/94 |
| 2,304,574 | 12/1942 | Kirschenbaum | 2/94 |
| 4,526,298 | 7/1985 | Boxer et al. | 224/148.2 |
| 4,601,067 | 7/1986 | Buonassissi | 2/94 |
| 4,948,023 | 8/1990 | Tripp | 224/148.2 |
| 5,060,833 | 10/1991 | Edison et al. . | |
| 5,123,117 | 6/1992 | Prendergast . | |
| 5,165,111 | 11/1992 | Lieberman . | |
| 5,247,707 | 9/1993 | Parker et al. . | |
| 5,303,425 | 4/1994 | Mele | 2/115 |
| 5,305,471 | 4/1994 | Steele et al. | 2/94 |
| 5,415,222 | 5/1995 | Colvin et al. | 2/102 |
| 5,465,885 | 11/1995 | Wyatt . | |
| 5,524,293 | 6/1996 | Kung | 2/94 |
| 5,584,074 | 12/1996 | Battle-Smith | 2/108 |
| 5,722,573 | 3/1998 | Carnel | 224/148.2 |

OTHER PUBLICATIONS

"First Strapless Watering System" advertisement of Rooboy Racing; Mountain Biker, Oct. 1997, p. 122.

"Best Way To Hold Your Bladder, Louis Garneau Hydrowear", Bicycling, Nov./Dec. 1997, p. 85.

"Top Wear" Outside Bike Accessories Buyer's Guide, 998, p. 146.

"Stay Fast and Wet. Camelbak's AeroVest", Bicycling, Jan./Feb. 1998, p. 95.

"What's New in Water Wear . . . Strider Water Bug Jersey", Bicycling, Mar. 1998, p. 191.

CamelBak AeroBak/IceBak advertisement, Bicycling, May 1998, p. 20.

*Primary Examiner*—Amy B. Vanatta
*Attorney, Agent, or Firm*—Oyen Wiggs Green & Mutala

[57] ABSTRACT

A jersey having a back and an openable front. An enclosure is connected to the back for removable insertion of a liquid-fillable bladder within the enclosure. A shoulder harness is connected between upper and lower portions of the enclosure for shoulder support of the liquid-fillable bladder when the jersey is worn with the liquid-fillable bladder inserted within the enclosure. The shoulder harness has left and right upper straps which are respectively connected to the left and right sides of the upper enclosure portion; and, left and right lower straps which are respectively connected to left and right sides of the lower enclosure portion. A left strap coupler adjustably couples the left upper strap to the left lower strap; and, a right strap coupler adjustably couples the right upper strap to the right lower strap. The shoulder harness is also provided with bladder supports. One end of a left bladder support is connected to the left side of the upper enclosure portion, with its opposite end being free for removable, supportable attachment to the liquid-fillable bladder. Similarly, one end of a right bladder support is connected to the right side of the upper enclosure portion, with its opposite end being free for removable, supportable attachment to the liquid-fillable bladder. The left bladder support is further connected to the left upper strap; and, the right bladder support is further connected to the right upper strap.

16 Claims, 10 Drawing Sheets

JERSEY FOR USE WITH LIQUID DELIVERY SYSTEM

REFERENCE TO RELATED APPLICATION

This application claims the benefit of United States Provisional Application Ser. No. 60/051,423 filed 1 Jul., 1997.

TECHNICAL FIELD

This invention pertains to a jersey for use with a liquid delivery system, and more particularly to an athletic jersey having a rear enclosure for removably holding a liquid-filled bladder. A shoulder harness supports the bladder while the jersey is worn.

BACKGROUND

When an athlete is involved in training or competition, stopping to drink is not practical. Accordingly, athletes commonly carry liquids in some form of container from which they may drink as they train or compete. For example, bicyclists often carry one or more water bottles which are removably mounted in cages fixed to the bicycle frame. Some bicyclists (or other athletes) carry larger volumes of drinking fluids in back-pack style carriers.

Such back-pack style carriers, of which the CAMELBAK™ carrier (see U.S. Pat. No. 5,060,833) is exemplary, typically incorporate a flexible, non-porous drinking liquid container called a "bladder". A shoulder harness fixed to the bladder is worn to support the bladder on the bicyclist's back. By sucking on a mouthpiece fitted to a flow line which extends into the bladder, the bicyclist can draw drinking fluid from the bladder into his/her mouth on demand.

Prior art back-pack style carriers are subject to a number of disadvantages. For example, since the shoulder harness is commonly worn outside the bicyclist's clothing, there is a possibility that the entire apparatus (which can weigh ten or more pounds, when filled with liquid) may shift in position or become dislodged entirely, should either or both of the shoulder harness straps loosen or break during vigorous cycling. This could in turn adversely affect the bicyclist's balance, posing a potential hazard to the bicyclist and/or persons nearby.

Prior art back-pack style carriers also tend to be uncomfortable: the shoulder support straps transfer the weight of the heavy liquid-filled bladder to the bicyclist's shoulders in a manner which can restrict blood circulation in the arms, causing a loss of feeling in the arms and hands. Further, prior art externally worn back-pack style carriers can contribute to aerodynamic drag. The externally worn back-pack style carrier also tends to obstruct onlookers' view of logos or other artwork on the bicyclist's jersey. Unobstructed exposure of logos and proprietary artwork can be a condition of sponsorship under which an athlete participates in an event.

Because most prior art back-pack style carriers are thermally isolated from the athlete's body by the clothing over which the carrier is worn, cool liquid in the bladder has minimal cooling effect on the athlete's body during warm weather conditions. Additionally, because a back-pack style carrier can cover a substantial portion of the athlete's back, there can be a tendency for the athlete's body to overheat during warm weather conditions, potentially reducing performance. Conversely, in cold weather conditions, the externally worn back-pack style carrier can be exposed to temperatures sufficiently low to freeze the liquid within the bladder, rendering the apparatus inoperable.

Some athletes wear prior art back-pack style carriers beneath a jersey or jacket. Although this can somewhat alleviate the aforementioned thermal problems, other problems remain and/or arise. For example, the jersey, jacket etc. must be loose fitting, which can be uncomfortable. Further, the jersey, jacket etc. must be removed if the bladder is to be refilled. That can be inconvenient, especially if the user is competing in a timed event.

In an effort to address the foregoing disadvantages the art has evolved somewhat. For example, Louis Garneau Sports Inc. of St. Augustin-De-Desmaures, Quebec, Canada markets a cycling jersey having an integral dorsal water pack under the trademark HYDROWEAR. In the HYDROWEAR jersey, a liquid-filled bladder is contained within a pocket formed in the back of the jersey. However, the heavy, unconstrained, liquid-filled bladder settles to the base of the pocket, forming an uncomfortable mass which pulls the front of the jersey rearwardly and downwardly. This can make breathing difficult, as the jersey is drawn tightly against the athlete's neck. The unconstrained bladder can also shift in position within the pocket, causing discomfort and/or imbalance. If the front of the jersey is unzipped even partially, the weight of the liquid-filled bladder can cause the zipper to open and pull the jersey off the athlete's shoulders. Consequently, prior art jerseys having integral liquid-filled bladders must we worn quite tightly to prevent movement of the bladder. This can be uncomfortable for many athletes, and does not solve the aforementioned breathing difficulty problem.

The present invention addresses the foregoing problems.

SUMMARY OF THE INVENTION

The invention provides a jersey having a back and an openable front. An enclosure is connected to or formed in the back of the jersey, for removable insertion of a liquid-fillable bladder within the enclosure. A shoulder harness is connected between upper and lower portions of the enclosure for shoulder support of the liquid-fillable bladder when the jersey is worn with the liquid-fillable bladder inserted within the enclosure.

The shoulder harness has left and right upper straps which are respectively connected to the left and right sides of the upper enclosure portion; and, left and right lower straps which are respectively connected to left and right sides of the lower enclosure portion. A left strap coupler adjustably couples the left upper strap to the left lower strap; and, a right strap coupler adjustably couples the right upper strap to the right lower strap.

Advantageously, the shoulder harness is also provided with bladder supports. Specifically, one end of a left bladder support is connected to the left side of the upper enclosure portion, with its opposite end being free for removable, supportable attachment to the liquid-fillable bladder. Similarly, one end of a right bladder support is connected to the right side of the upper enclosure portion, with its opposite end being free for removable, supportable attachment to the liquid-fillable bladder. Preferably, the left bladder support is further connected to the left upper strap; and, the right bladder support is further connected to the right upper strap.

For example, hook and loop type fastening material can be provided on separate portions of each of the left and right bladder supports. The free ends of the respective bladder supports can then be inserted through apertures in the liquid-fillable bladder, and the strap portions bearing the fastening material engaged to form closed loops supporting the liquid-fillable bladder.

DESCRIPTION

Figure 1:
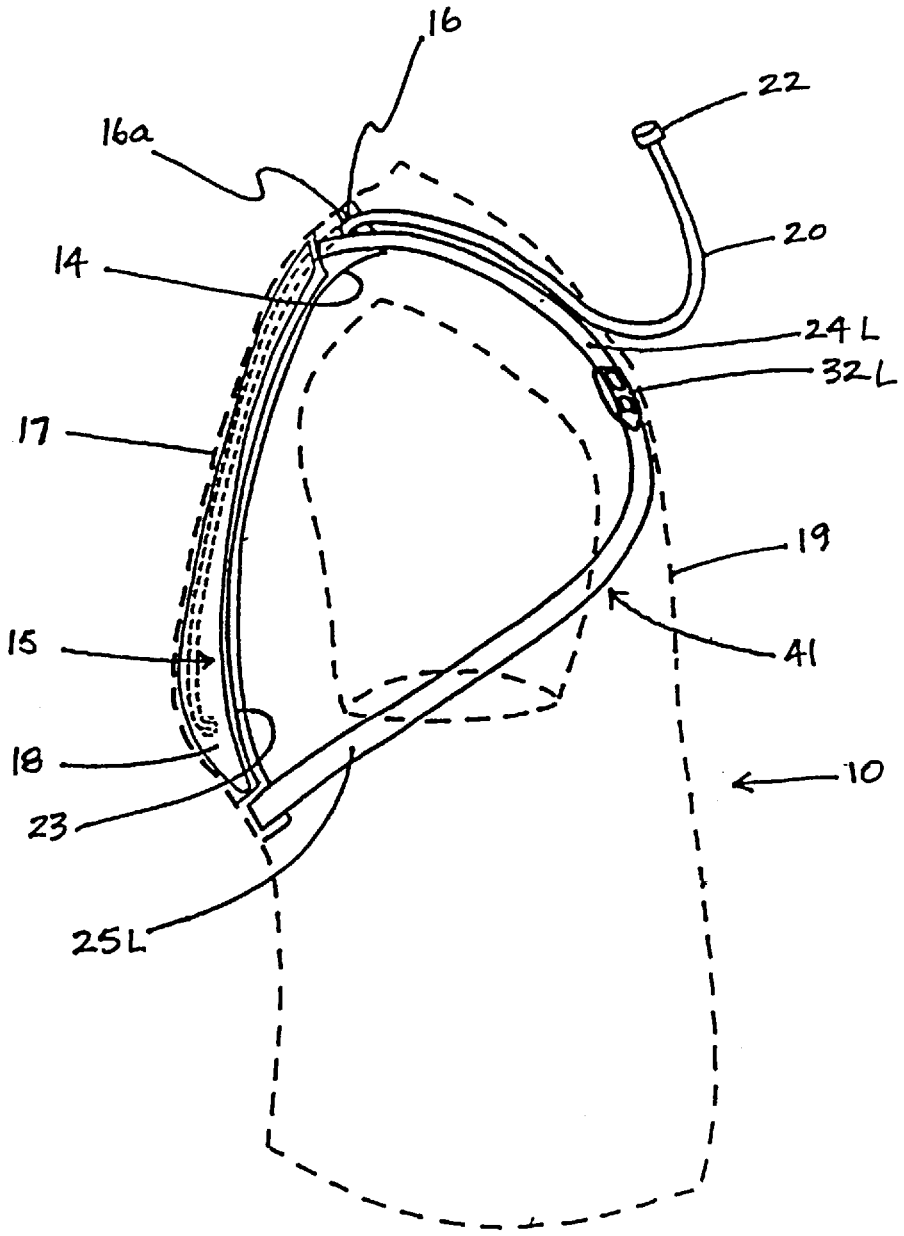
FIG. 1 is a side elevation view of the preferred embodiment of the invention, showing the jersey body in dashed outline and showing an integral shoulder harness in solid lines.

The drawings depict a jersey generally designated 10 having conventional back and openable front portions 17, 19. A fabric panel 14 is stitched along its left, right and bottom edges to jersey back 17, forming an enclosure 15 into which a conventional liquid-fillable bladder 18 can be removably inserted as hereinafter explained. A shoulder harness 41 is connected between upper and lower portions of enclosure 15 to support bladder 18 when jersey 10 is worn with bladder 18 filled with liquid and inserted within enclosure 15. Preferably, harness 14 is connected to the portion of enclosure 15 formed by panel 14.

Shoulder harness 41 includes left and right upper straps 24L, 24R; left and right lower straps 25L, 25R; and, left and right cross-straps 26L, 26R. One end of left upper strap 24L is securely fastened (for example, by stitching) to the upper left side of panel 14; and, one end of right upper strap 24R is securely fastened to the right upper side of panel 14. Similarly, one end of each of left and right lower straps 25L, 25R is securely fastened to the left and right lower sides of panel 14 respectively. A conventional buckle-type strap coupler 32L is provided to adjustably couple the free ends of left upper and lower straps 24L, 25L; and, an identical strap coupler 32R is provided to adjustably couple the free ends of right upper and lower straps 24R, 25R for comfortable wearing when jersey 10 is donned as hereinafter explained. Left cross-strap 26L is securely fastened at one end to a frontal portion of left upper strap 24L; and, right cross-strap 26R is securely fastened at one end to a frontal portion of right upper strap 24R. Another buckle-type coupler 34 is provided to adjustably couple the free ends of left and right cross-straps 26L, 26R after jersey 10 is donned.

As best seen in FIGS. 5, 6, 8 and 9 additional bladder supports 21L, 21R are provided. Specifically, one end of left bladder support strap 21L is securely fastened to the left upper side of panel 14 (and is preferably also securely fastened to left upper strap 24L at its point of affixation to panel 14). Similarly, one end of right bladder support strap 21R is securely fastened to the right upper side of panel 14 (and is also preferably fastened to right upper strap 24L at its point of affixation to panel 14). The opposed ends of bladder support straps 21L, 21R remain free for removable, supportable attachment to bladder 18 so as to transfer a substantial portion of the weight of the liquid-filled bladder to shoulder harness 41.

Figure 9:
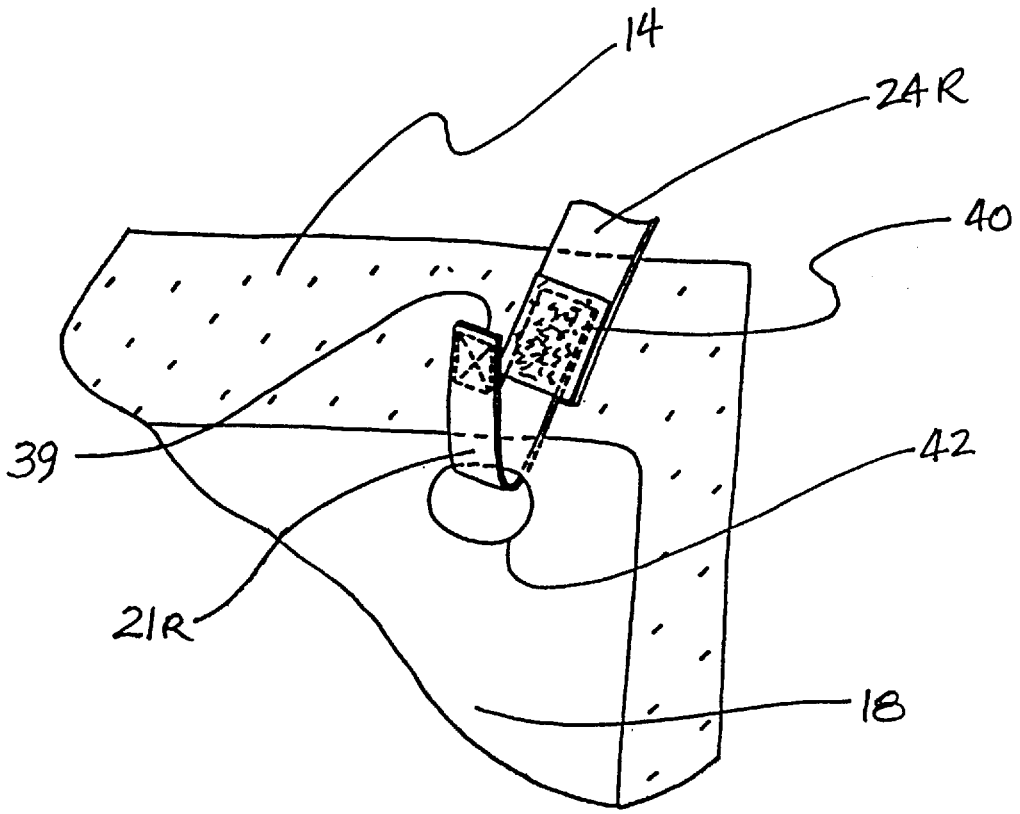
FIG. 9 is an enlarged rear perspective view, showing an upper right corner portion of the rear panel and bladder, and showing a removably attachable bladder support strap.
Figure 10B:
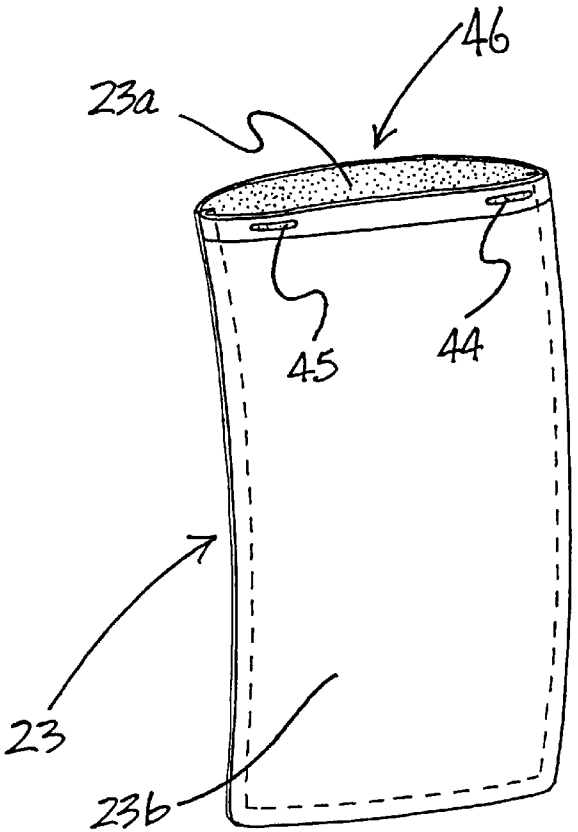
FIG. 10B is a perspective view of the thermally insulating pouch of FIG. 10A.
Figure 10A:
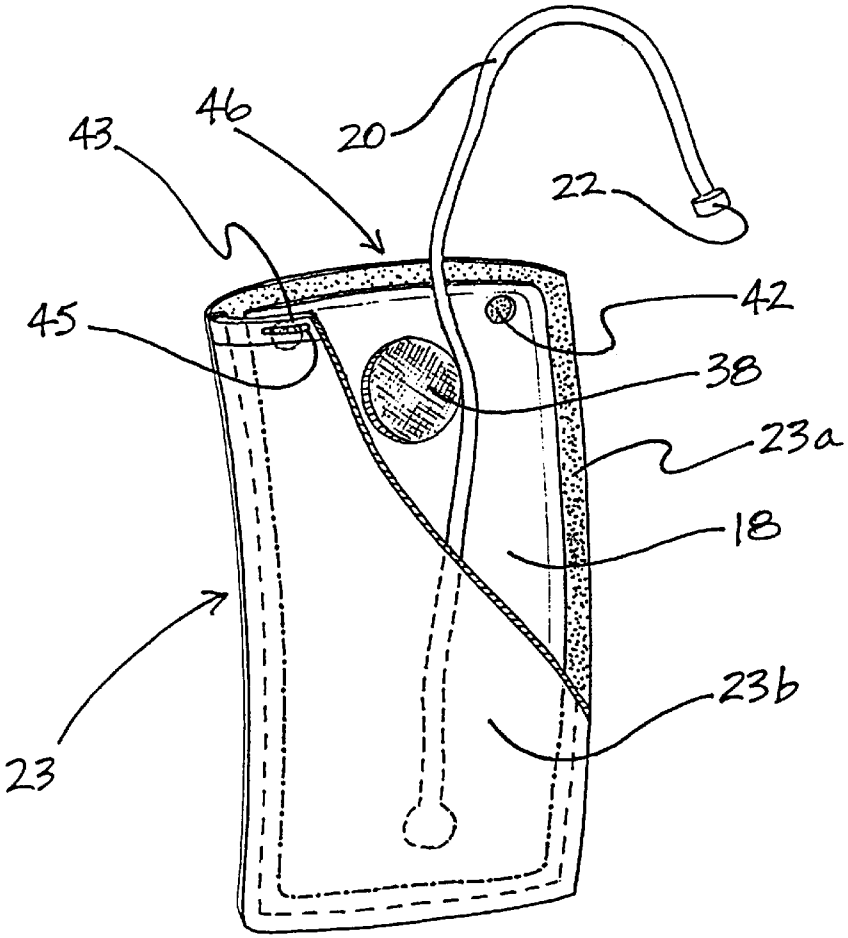
FIG. 10A is a partially fragmented perspective view of a thermally insulating pouch enveloping a bladder.

Such removable, supportable attachment is preferably implemented by providing VELCRO™ hook and loop type fastening material on the bladder support straps. For example, as best seen in FIG. 9, a piece of loop type fastening material 40 is secured to an inward portion of bladder support strap 21R and a piece of hook type fastening material 39 is secured to an end portion of the same strap. An aperture 42 is provided in the upper right portion of bladder 18. The free end of bladder support strap 21R can thus be inserted through aperture 42, after which hook type fastening material 39 is pressed against loop type fastening material 40, thereby forming a closed loop supporting bladder 18. Left bladder support strap 21L is configured in identical fashion for removable, supportable attachment to bladder 18 by insertion through a second aperture 43 provided in bladder 18.

If desired, bladder 18 can be enveloped within a thermally insulating member such as pouch 23 (FIGS. 1, 6, 10A and 10B). One face 23A of pouch 23 may be formed of a relatively thick, thermally insulating micro fleece material, with the opposite face 23B of pouch 23 being formed of a thinner, perforated micro fleece material having significantly less thermally insulating capability than the material which forms face 23A. This construction facilitates insertion of bladder 18 within pouch 23 in either one of two orientations. Specifically, pouch 23 can be oriented to position thermally insulating face 23A between bladder 18 and panel 14 when jersey 10 is donned. In this orientation, thermally insulating face 23A thermally isolates bladder 18 from the body of the person wearing jersey 10. Alternatively, pouch 23 can be oriented to position thermally insulating face 23B between bladder 18 and panel 14 when jersey 10 is donned, thus positioning thermally insulating face 23A between bladder 18 and jersey back 17. In this orientation, cool liquid within bladder 18 has a greater cooling effect on the body of the person wearing jersey 10 in warmer weather; and/or, in colder weather, thermally insulating face 23A protects bladder 18 from freezing temperatures.

Slits 44, 45 (FIGS. 10A, 10B) are provided in the upper left and right portions of pouch 23. Bladder support straps 24R, 24L are simultaneously inserted through apertures 42, 43 and slits 44, 45 respectively when the bladder support straps are attached to support bladder 18 as aforesaid. Such attachment of bladder support straps 24R, 24L through slits 44, 45 prevents pouch 23 slipping downwardly with respect to bladder 18.

As previously explained, panel 14 is stitched to jersey back 17 along the left, right and bottom edges of panel 14. This leaves an aperture 16 across the top of enclosure 15 through which bladder 18 can be removably inserted into enclosure 15. If desired, a closure member such as zipper 16A can be connected between jersey back 17 and the upper edge of panel 14 to fully enclose bladder 18 after insertion thereof into enclosure 15.

Figure 2:
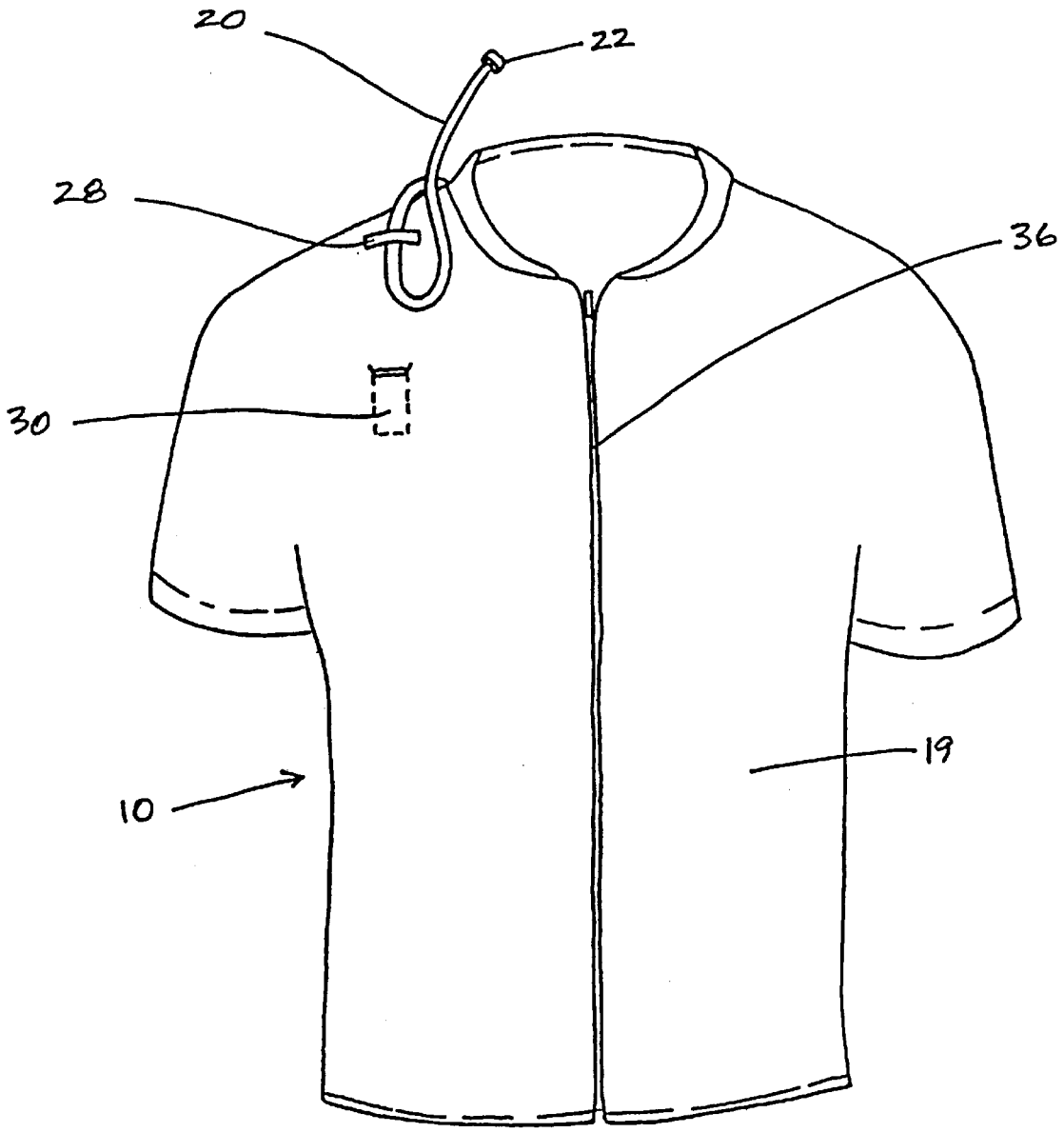
FIG. 2 is a front elevation view of the jersey.
Figure 3:
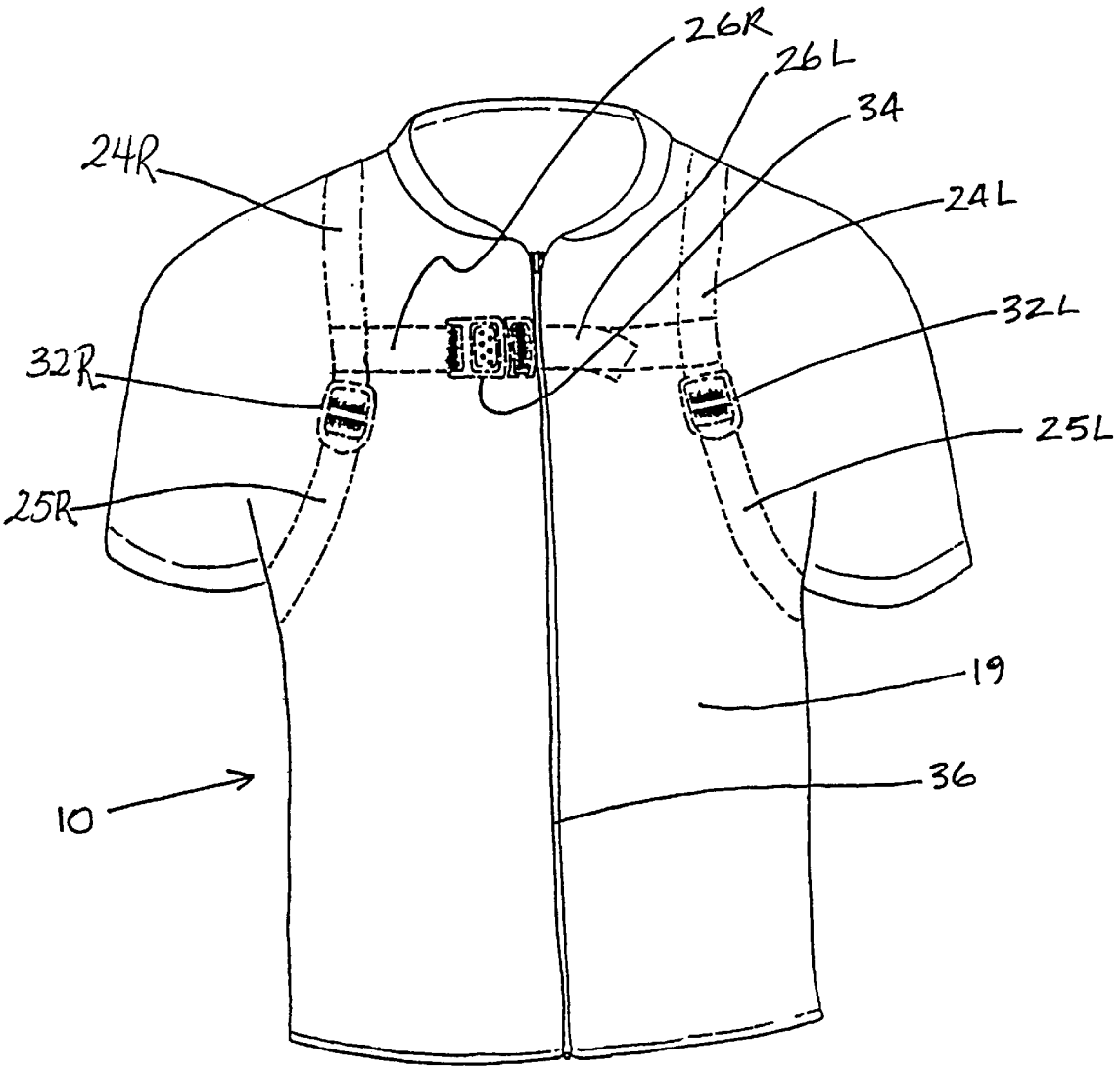
FIG. 3 is another front elevation view, showing a frontal portion of the shoulder harness in dashed outline.
Figure 4:
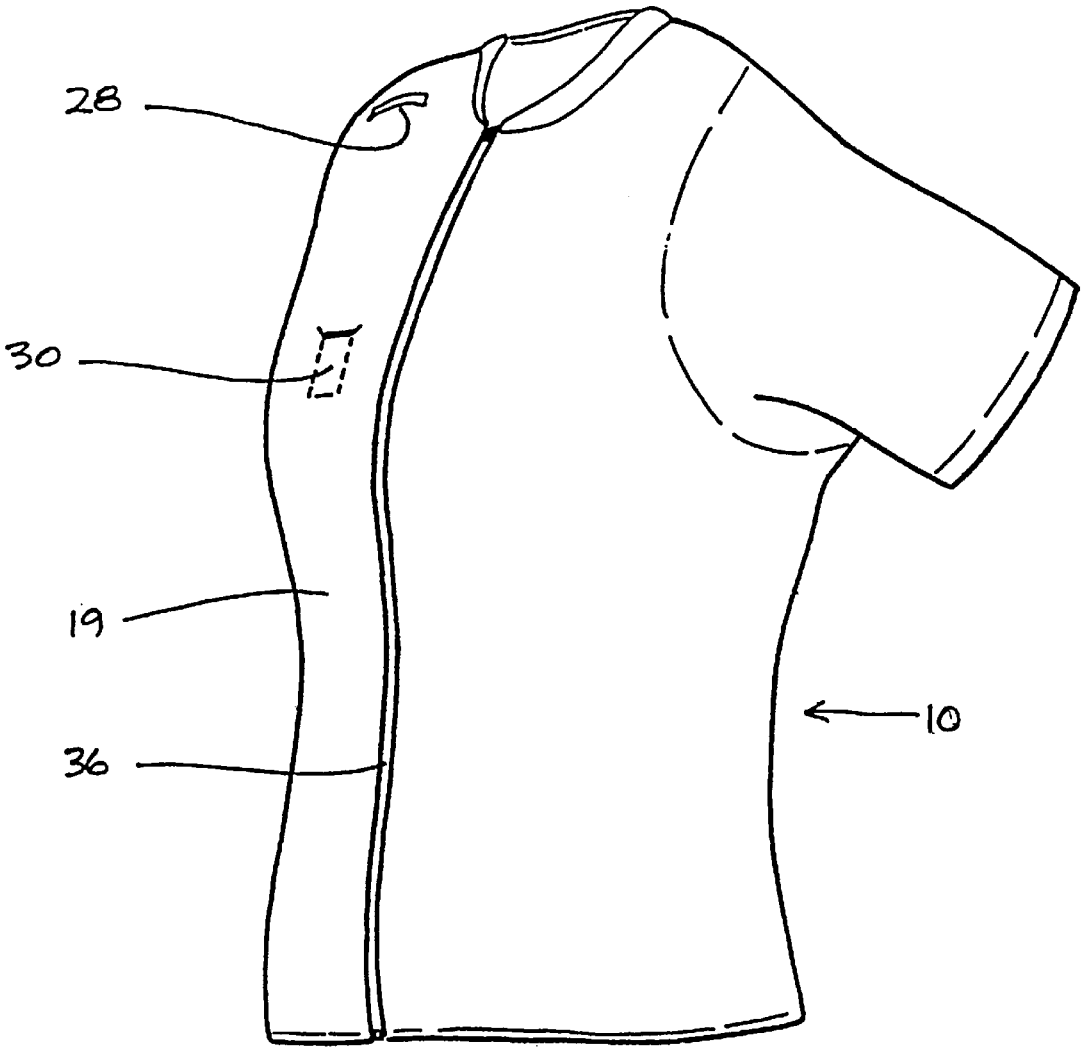
FIG. 4 is a front perspective view of the jersey.
Figure 5:
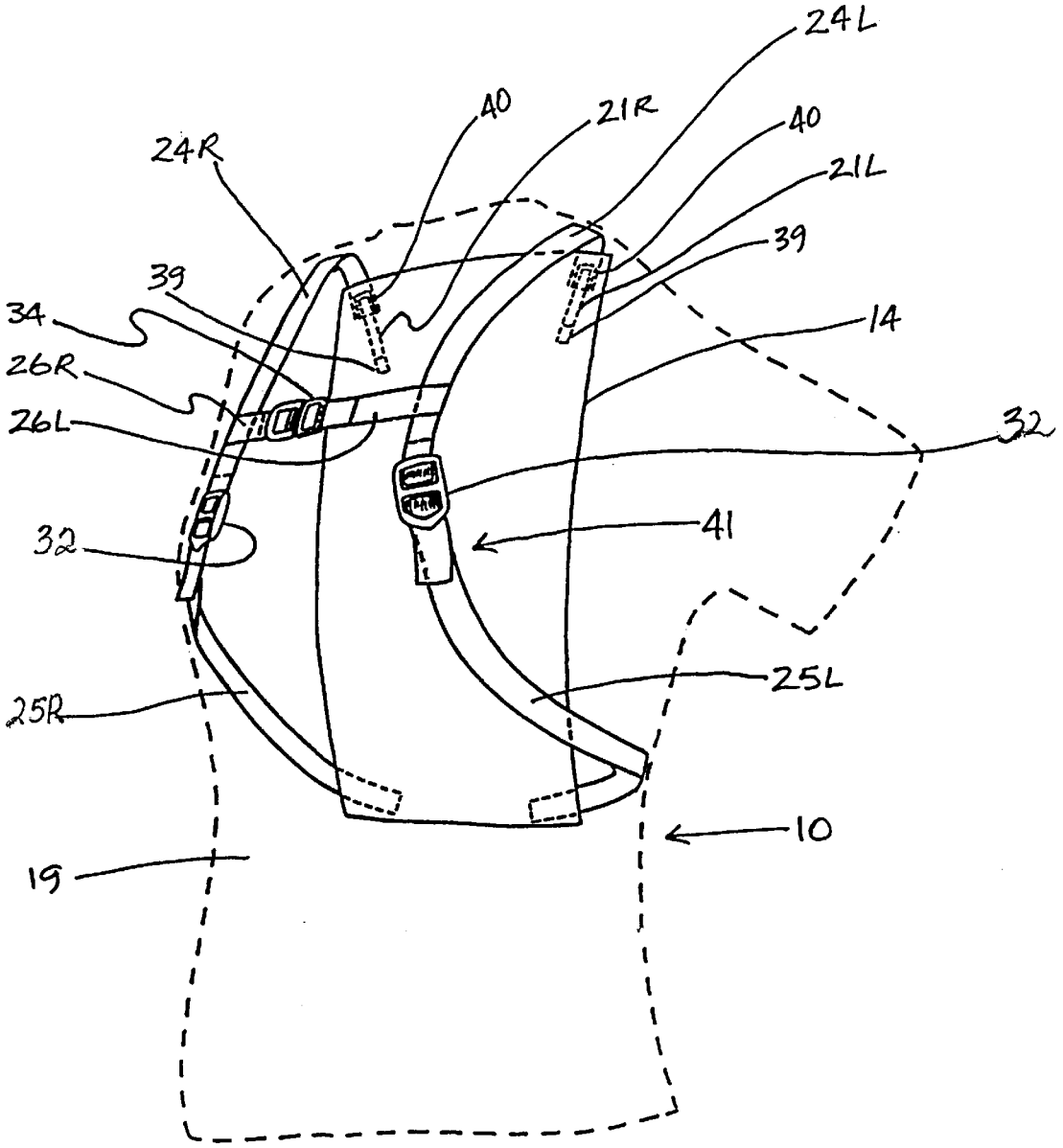
FIG. 5 is another front perspective view, showing the shoulder harness and a rear panel in solid lines, with the jersey body in dashed outline.
Figure 6:
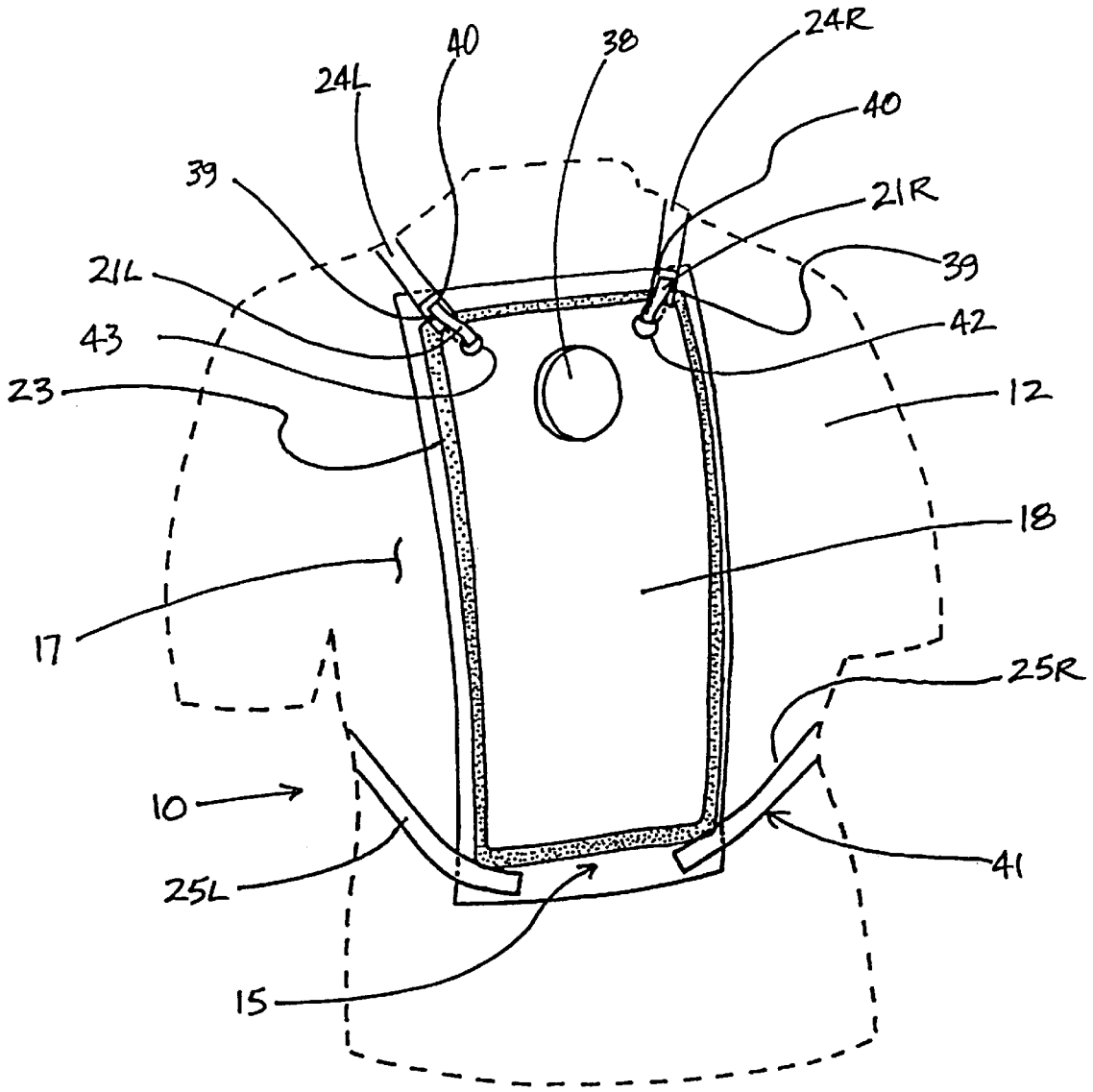
FIG. 6 is a rear perspective view, showing a portion of the shoulder harness, the rear panel, a bladder and a portion of a thermally insulating pouch in solid lines, with the jersey body in dashed outline.
Figure 7:
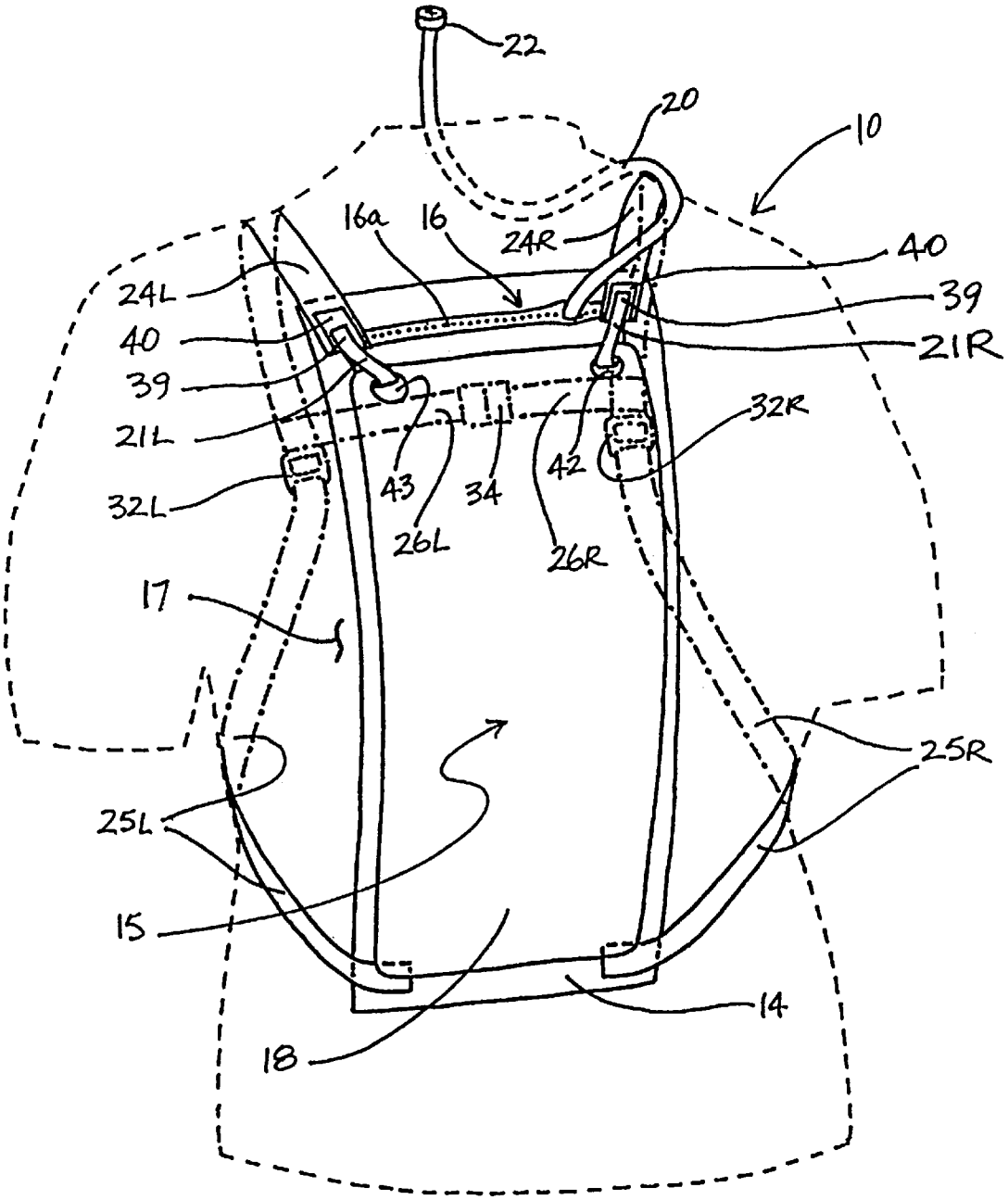
FIG. 7 is similar to FIG. 6 and shows further portions of the shoulder harness and bladder enclosure.
Figure 8:
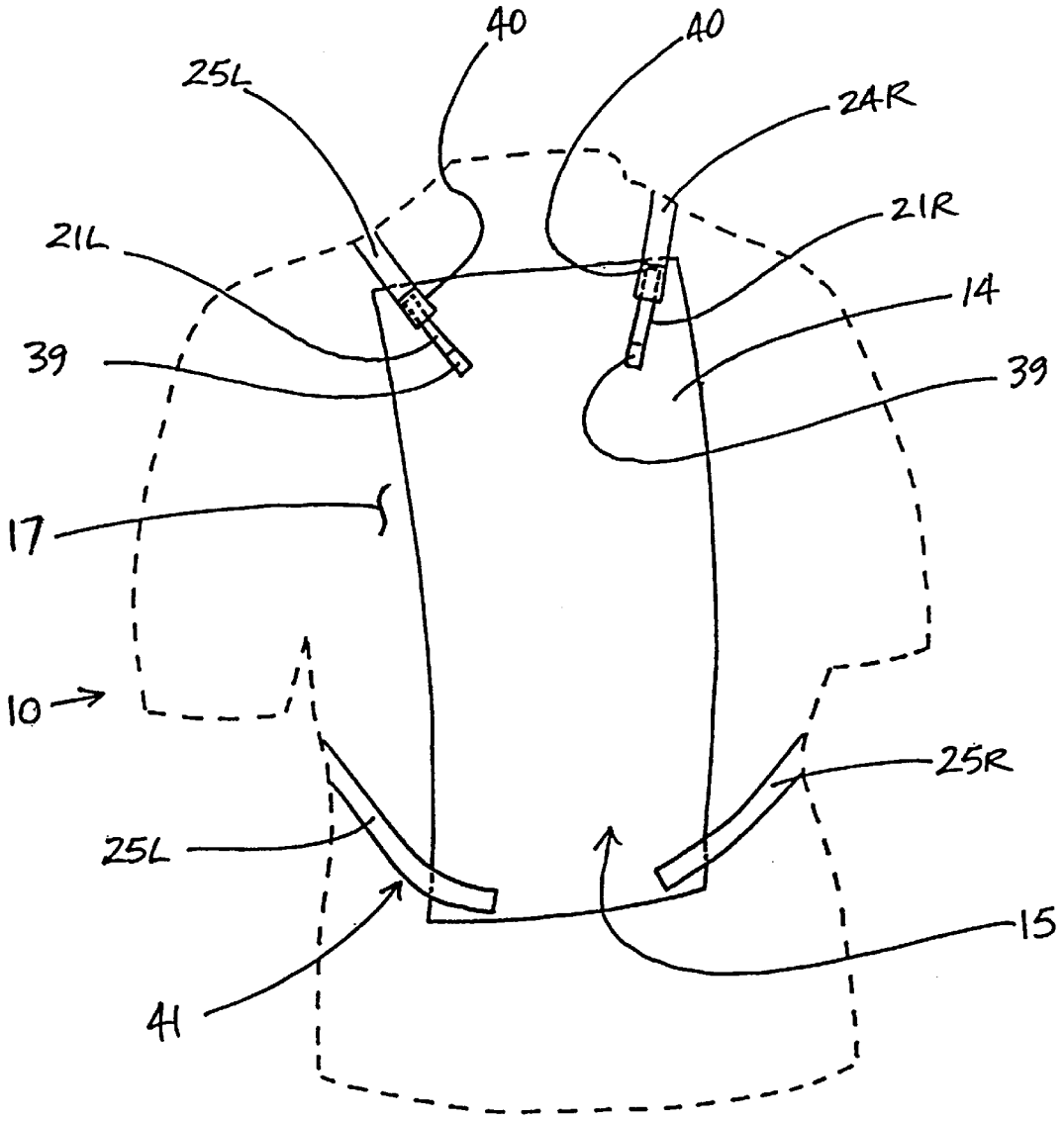
FIG. 8 is another rear perspective view, showing portions of the shoulder harness and the rear panel in solid lines, with the jersey body in dashed outline.

As best seen in FIGS. 1 and 2, bladder 18 is conventionally provided with a flow line 20 having a mouth piece 22. Liquid can be drawn into the mouth of a person wearing jersey 10 by sucking on mouthpiece 22. Advantageously, a fabric loop 28 is stitched onto an upper frontal portion of jersey front 19. The mouthpiece end of flow line 20 is threaded through loop 28 to hold flow line 20 and mouthpiece 22 in a convenient position for hands-free access. A small pocket 30 can also be provided in an upper frontal portion of jersey front 19 for removable storage of mouthpiece 22 in pocket 30 when not in use. Pocket 30 minimizes foreign matter accumulation on mouthpiece 22 and inhibits freezing of mouthpiece 22 when inserted within pocket 30.

A closure member such as zip fastener 36 is provided in jersey front 19 to define a removably fastenable opening extending from the neck portion to the waist portion of jersey 10. Zip fastener 36 can be undone to fully open and separate the left and right frontal portions of jersey 10 to facilitate donning of jersey 10. If jersey front 19 cannot be fully opened as aforesaid then donning and removal of jersey 10 can be difficult and cumbersome, since the jersey and its heavy liquid-filled bladder must be manipulated over the user's head and upper torso.

In operation, bladder 18 is first disconnected by opening zip fastener 16A and then pulling apart the hook and loop portions of bladder support straps 21L, 21R. The free ends of bladder support straps 21L, 21 R are then drawn through apertures 42, 43 respectively, freeing bladder 18 from connection to jersey 10. Bladder 18 is then withdrawn from enclosure 15 and flow line 20 is simultaneously withdrawn through loop 28. Bladder 18 is then filled with a suitable drinking fluid through capped filler port 38. After the filler cap is replaced, the liquid-filled bladder 18 is optionally enveloped within thermally insulating pouch 23 (which is oriented as aforesaid with respect to bladder 18) and then reinserted within enclosure 15. Bladder support straps 21L, 21R are refastened through apertures 42, 43 respectively, zip fastener 16A is closed, and flow line 20 is threaded through loop 28. Jersey zip fastener 36 is then opened to separate the left and right frontal portions of jersey 10 and cross-strap connector 36 is unbuckled to separate left and right cross-straps 26L, 26R. Jersey 10 is then donned, with care being taken by the user to pass his/her arms through the connected left and right strap pairs 24L, 25L and 24R, 25R. Cross-straps 26L, 26R are then reconnected by means of cross-strap coupler 34. Shoulder harness 41 is then adjusted to the user's comfort in conventional fashion by tightening or loosening the straps with the aid of couplers 32L, 32R, 34. Zip fastener 36 can then be wholly or partially closed, as desired by the user.

When harness 41 is properly adjusted, bladder 18 is positioned between the user's shoulders, approximately mid level of the user's back. Besides being comfortable, this position permits cool liquids within bladder 18 to cool the user's body if thermally insulating pouch 23 is not used, or if pouch 23 is oriented to position thermally insulating face 23B between bladder 18 and panel 14 as aforesaid. Cross-strap coupler 34 is properly fitted when located at a point across the user's middle sternum area.

Persons skilled in the art will understand that the invention is less bulky and more comfortable than prior art devices. Support harness 41 supports the weight of bladder 18; and, because harness 41 is fully enclosed by jersey 10, bladder 18 is less prone to shifting or dislodgement, should any of the straps loosen or break. Further, jersey back 17 remains unobstructed, improving aerodynamic air flow over the user's back and affording clear viewing of any art work, sponsors' logos, race identification numbers, etc. on the user's back.

Although the invention has been described in the context of a bicyclist's jersey, it is of general application. For example, the invention is readily adapted for use by distance runners by configuring jersey 10 in a more loose-fitting style than a tighter-fitting bicyclist's jersey. In such case, harness 41 is particularly advantageous, since without it, bladder 18 would not be securely supported. The invention can also be configured as an outer wear garment adapted for use in other activities such as skiing or motorcycling by making jersey 10 of a heavier fabric, providing long sleeves, etc.

As will be apparent to those skilled in the art in the light of the foregoing disclosure, many alterations and modifications are possible in the practice of this invention without departing from the spirit or scope thereof. For example, panel 14 need not be rectangular as illustrated, but may be shaped and sized to conform to a particular style of bladder. Further, instead of forming enclosure 15 by stitching panel 14 to jersey back 17, one could substitute for panel 14 a pouch having a pre-formed enclosure for containing bladder 18 and attach such pouch to the inside or outside of jersey back 17. Indeed, thermally insulating pouch 23 could be adapted in this way to serve as enclosure 15. The harness straps may be of various sizes, they may be elasticized or non-elasticized, and/or they may be formed integrally with panel 14. (Elasticized straps are preferred, because they permit contraction and expansion of the harness during heavy breathing and/or during withdrawal of liquid from bladder 18, while maintaining bladder 18 securely in position.)

As further examples, panel 14 may be fastened to the inner or outer face of jersey back 17. Instead of buckle-type strap couplers, one may substitute VELCRO™ or other suitable couplers. Instead of providing bladder 18 with apertures 42, 43 and inserting bladder support straps 21R, 21L therethrough, one could alternatively provide fasteners on the upper left and right portions of the bladder itself for attachment to mating fasteners on the bladder support straps. Fasteners other than hook and loop type material, such as snap or buckle type fasteners, may be used for this purpose. Accordingly, the scope of the invention is to be construed in accordance with the substance defined by the following claims.

What is claimed is:

1. A jersey comprising:

(a) a back;

(b) an openable front;

(c) a bladder enclosure connected to said back, for removable insertion of a liquid-fillable bladder within said enclosure; and, (d) a shoulder harness connected between upper and lower portions of said enclosure for shoulder support of said liquid-fillable bladder when said jersey is worn with said liquid-fillable bladder inserted within said enclosure.

2. A jersey as defined in claim 1, wherein said shoulder harness further comprises:

(a) left and right upper straps respectively connected to left and right sides of said upper enclosure portion;

(b) left and right lower straps respectively connected to left and right sides of said lower enclosure portion;

(c) a left strap coupler for adjustably coupling said left upper strap to said left lower strap; and, (d) a right strap coupler for adjustably coupling said right upper strap to said right lower strap.

3. A jersey as defined in claim 2, wherein said shoulder harness further comprises:

(a) a left bladder support having one portion connected to said left side of said upper enclosure portion and having an opposite portion removably and supportably attachable to said liquid-fillable bladder; and, (b) a right bladder support having one portion connected to said right side of said upper enclosure portion and having an opposite portion removably and supportably attachable to said liquid-fillable bladder.

4. A jersey as defined in claim 3, wherein:

(a) said left bladder support is further connected to said left upper strap; and, (b) said right bladder support is further connected to said right upper strap.

5. A jersey as defined in claim 3, further comprising:

(a) hook type fastening material on one portion of said left bladder support;

(b) loop type fastening material on another portion of said left bladder support;

(c) hook type fastening material on one portion of said right bladder support;

(d) loop type fastening material on another portion of said right bladder support; wherein:

(i) said left bladder support opposite end is removably insertable through a first aperture in said liquid-fillable bladder for subsequent removable fastening engagement of said left bladder support hook and loop type fastening materials with said left bladder support forming a closed loop supporting said liquid-fillable bladder; and, (ii) said right bladder support opposite end is removably insertable through a second aperture in said liquid-fillable bladder for subsequent removable fastening engagement of said right bladder support hook and loop type fastening materials with said right bladder support forming a closed loop supporting said liquid-fillable bladder.

6. A jersey as defined in claim 3, wherein said shoulder harness further comprises:

(a) a left cross-strap connected at one end to a frontal portion of said left upper strap;

(b) a right cross-strap connected at one end to a frontal portion of said right upper strap; and, (c) a cross-strap coupler for adjustably coupling said left cross-strap to said right cross-strap.

7. A jersey as defined in claim 3, further comprising a thermal insulation member positionable within said enclosure to thermally insulate a person wearing said jersey from said liquid-fillable bladder.

8. A jersey as defined in claim 7, wherein said thermal insulation member further comprises a pouch for enveloping said bladder.

9. A jersey as defined in claim 8, wherein said pouch further comprises one face formed of a thermally insulating material and an opposed face formed of a non-thermally insulating material, said pouch orientable either to position said thermally insulating material between said bladder and said jersey back, or to position said non-thermally insulating material between said bladder and said jersey back.

10. A jersey as defined in claim 3, further comprising a closure member connected between said back and an upper edge of said enclosure to define a closable aperture across an upper portion of said enclosure.

11. A jersey as defined in claim 3, further comprising a pocket in an upper frontal portion of said jersey front for removable insertion into said pocket of a mouthpiece portion of a liquid flow line coupled to said bladder.

12. A jersey as defined in claim 3, further comprising a loop fixed to an upper frontal portion of said jersey front for removable passage through said loop of a liquid flow line coupled to said bladder.

13. A jersey as defined in claim 3, wherein said jersey openable front further comprises a removably fastened opening extending from a neck portion to a waist portion of said jersey, whereby said jersey may be fully opened to separate left and right frontal portions of said jersey.

14. A jersey as defined in claim 3, wherein said straps are formed of an elastic material.

15. A jersey as defined in claim 3, wherein said enclosure is formed by connecting a panel to said back.

16. A jersey as defined in claim 3, wherein said enclosure is formed by connecting a pouch having a pre-formed bladder enclosure to said back.

* * * * *